US010880658B1

(12) United States Patent
Olah et al.

(10) Patent No.: US 10,880,658 B1
(45) Date of Patent: Dec. 29, 2020

(54) HEARING AID AND METHOD FOR USE OF SAME

(71) Applicant: Texas Institute of Science, Inc., Richardson, TX (US)

(72) Inventors: Laslo Olah, Richardson, TX (US); Grigorii Sokolovskii, St. Petersburg (RU); Sergey Losev, St. Petersburg (RU); Ekaterina Sokolovskaya, The Hague (NL)

(73) Assignee: Texas Institute of Science, Inc., Richardson, TX (US)

( * ) Notice: Subject to any disclaimer, the term of this patent is extended or adjusted under 35 U.S.C. 154(b) by 0 days.

(21) Appl. No.: 17/027,208

(22) Filed: Sep. 21, 2020

Related U.S. Application Data

(63) Continuation-in-part of application No. 16/959,972, filed as application No. PCT/US2019/012550 on Jan. 7, 2019.

(Continued)

(51) Int. Cl.
*H04R 25/00* (2006.01)

(52) U.S. Cl.
CPC ..... *H04R 25/502* (2013.01); *H04R 25/305* (2013.01); *H04R 25/65* (2013.01)

(58) Field of Classification Search
CPC .... H04R 25/554; H04R 25/70; H04R 25/505; H04R 2225/41; H04R 25/356; H04R 25/558; H04R 25/00; H04R 2225/55; H04R 25/305; H04R 1/1083; H04R 2430/01; H04R 2460/01; H04R 2225/021; H04R 2499/11; H04R 25/60; H04R 2460/03; H04R 25/609; G10L 25/78; G10L 21/02; G10L 21/0272

(Continued)

(56) References Cited

U.S. PATENT DOCUMENTS 5,987,147 A 11/1999 Nishimoto
7,113,589 B2 9/2006 Mitchler (Continued)

FOREIGN PATENT DOCUMENTS

KR 20170026786 3/2017
WO 2019136382 7/2019

OTHER PUBLICATIONS

International Preliminary Report on Patentability—PCT/US2019/012550.
International Search Report—PCT/US2019/012550.

*Primary Examiner* — Norman Yu
(74) *Attorney, Agent, or Firm* — Scott Griggs; Griggs Bergen LLP

(57) ABSTRACT

A hearing aid and method for use of the same are disclosed. In one embodiment, the hearing includes a body that at least partially conforms to the contours of an external ear and is sized to engage therewith. Various electronic components are contained within the body, including an electronic signal processor that is programmed with a respective left ear qualified sound range and a right ear qualified sound range. Each of the left ear qualified sound range and the right ear qualified sound range may be a range of sound corresponding to a preferred hearing range of an ear of the patient modified with a subjective assessment of sound quality according to the patient. Sound received at the hearing aid is converted to the qualified sound range prior to output.

20 Claims, 9 Drawing Sheets

Related U.S. Application Data

(60) Provisional application No. 62/935,961, filed on Nov. 15, 2019, provisional application No. 62/904,616, filed on Sep. 23, 2019, provisional application No. 62/613,804, filed on Jan. 5, 2018.

(58) Field of Classification Search
USPC ..... 381/312, 315, 317, 318, 23.1, 56, 107, 381/106, 94.1, 104, 74, 94.3, 58, 57, 381/71.11, 71.1
See application file for complete search history.

(56) References Cited

U.S. PATENT DOCUMENTS

| | | | | |
|---|---|---|---|---|
| 8,565,460 | B2 | 10/2013 | Takagi et al. | |
| 8,761,421 | B2 | 6/2014 | Apfel | |
| 9,232,322 | B2 | 1/2016 | Fang | |
| 9,344,814 | B2 * | 5/2016 | Rasmussen | H04R 25/353 |
| 9,712,928 | B2 * | 7/2017 | Pedersen | H04R 25/558 |
| 10,181,328 | B2 | 1/2019 | Jensen et al. | |
| 2007/0230711 | A1 * | 10/2007 | Hasler | H04R 25/70 381/58 |
| 2013/0223661 | A1 | 8/2013 | Uzuanis | |
| 2014/0086417 | A1 * | 3/2014 | Hansen | H04R 25/43 381/23.1 |

* cited by examiner

HEARING AID AND METHOD FOR USE OF SAME

PRIORITY STATEMENT & CROSS-REFERENCE TO RELATED APPLICATIONS

This application claims the benefit from (1) U.S. Provisional Patent Application No. 62/935,961, entitled "Hearing Aid and Method for Use of Same" and filed on Nov. 15, 2019 in the name of Laslo Olah; and (2) U.S.Provisional Patent Application No. 62/904,616, entitled "Hearing Aid and Method for Use of Same" and filed on Sep. 23, 2019, in the name of Laslo Olah; both of which are hereby incorporated by reference, in entirety, for all purposes. This application is a continuation-in-part of co-pending U.S. patent application Ser. No. 16/959,972, entitled "Hearing Aid and Method for Use of Same" and filed on Jul. 2, 2020 in the name of Laslo Olah; which claims priority from International Application No. PCT/US19/12550, entitled "Hearing Aid and Method for Use of Same" and filed on Jan. 7, 2019 in the name of Laslo Olah; which claims priority from U.S. Provisional Patent Application Ser. No. 62/613,804, entitled "Hearing Aid and Method for Use of Same" and filed on Jan. 5, 2018 in the name of Laslo Olah; all of which are hereby incorporated by reference, in entirety, for all purposes.

This application discloses subject matter related to the subject matter disclosed in the following commonly owned, co-pending applications: (1) U.S. patent application Ser. No. 17/026,955 entitled "Hearing Aid and Method for Use of Same" and filed on Sep. 21, 2020, in the names of Laslo Olah et al.; which claims the benefit from co-pending applications (a) U.S. Provisional Patent Application No. 62/935,961, entitled "Hearing Aid and Method for Use of Same" and filed on Nov. 15, 2019 in the name of Laslo Olah; and (b) U.S. Provisional Patent Application No. 62/904,616, entitled "Hearing Aid and Method for Use of Same" and filed on Sep. 23, 2019, in the name of Laslo Olah; and (2) U.S. patent application Ser. No. 17/027,225 entitled "Hearing Aid and Method for Use of Same" and filed on Sep. 21, 2020, in the names of Laslo Olah et al.; which claims the benefit from (a) U.S. Provisional Patent Application No. 62/935,961, entitled "Hearing Aid and Method for Use of Same" and filed on Nov. 15, 2019 in the name of Laslo Olah; and (b) U.S. Provisional Patent Application No. 62/904,616, entitled "Hearing Aid and Method for Use of Same" and filed on Sep. 23, 2019, in the name of Laslo Olah; all of which are hereby incorporated by reference, in entirety, for all purposes.

TECHNICAL FIELD OF THE INVENTION

This invention relates, in general, to hearing aids and, in particular, to hearing aids and methods for use of the same that provide signal processing and feature sets to enhance speech and sound intelligibility.

BACKGROUND OF THE INVENTION

Hearing loss can affect anyone at any age, although elderly adults more frequently experience hearing loss. Untreated hearing loss is associated with lower quality of life and can have far-reaching implications for the individual experiencing hearing loss as well as those close to the individual. As a result, there is a continuing need for improved hearing aids and methods for use of the same that enable patients to better hear conversations and the like.

SUMMARY OF THE INVENTION

It would be advantageous to achieve a hearing aid and method for use of the same that would significantly change the course of existing hearing aids by adding features to correct existing limitations in functionality. It would also be desirable to enable a mechanical and electronics-based solution that would provide enhanced performance and improved usability with an enhanced feature set. To better address one or more of these concerns, a hearing aid and method for use of the same are disclosed. In one embodiment, the hearing aid includes left and right bodies, which are connected by a band member, that at least respectively partially conform to the contours of the external ear and is sized to engage therewith. Various electronic components are contained within the body, including an electronic signal processor that is programmed with a respective left ear qualified sound range and a right ear qualified sound range. Each of the left ear qualified sound range and the right ear qualified sound range may be a range of sound corresponding to a preferred hearing range of an ear of the patient modified with a subjective assessment of sound quality according to the patient. Sound received at the hearing aid is converted to the qualified sound range prior to output. In another embodiment, the hearing aid may create a pairing via a transceiver with a proximate smart device, such as a smart phone, smart watch, or tablet computer. The hearing aid may use distributed computing between the hearing aid and the proximate smart device for execution of various processes. Also, a user may send a control signal from the proximate smart device to effect control.

In another embodiment, the hearing aid has a dominant sound mode of operation, an immediate background mode of operation, and a background mode of operation working together while being selectively and independently adjustable by the patient. In the dominant sound mode of operation, the hearing aid is able to identify a loudest sound in the processed signal and increases a volume of the loudest sound in the signal being processed. In the immediate background mode of operation, the hearing aid is able to identify sound in an immediate surrounding to the hearing aid and suppresses the sound in the signal being processed. In the background mode of operation, the hearing aid is able to identify extraneous ambient sound received at the hearing aid and suppress the extraneous ambient sound in the signal being processed. In a further embodiment, the hearing aid may create a pairing via a transceiver with a proximate smart device, such as a smart phone, smart watch, or tablet computer. The hearing aid may use distributed computing between the hearing aid and the proximate smart device for execution of various processes. Also, a user may send a control signal from the proximate smart device to activate one of the dominant sound modes of operation, the immediate background mode of operation, and the background mode of operation. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1A:
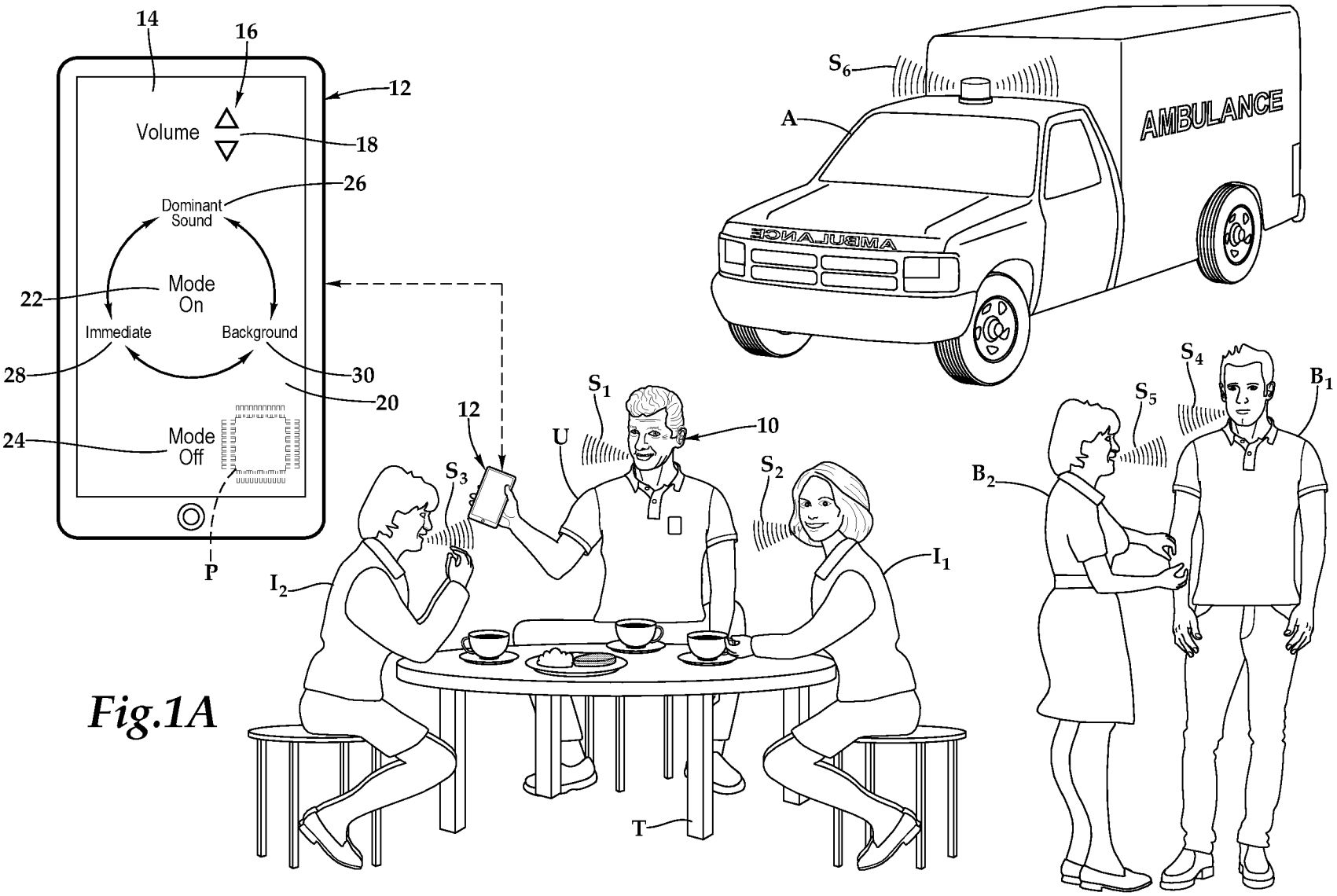
FIG. 1A is a front perspective schematic diagram depicting one embodiment of a hearing aid being utilized according to the teachings presented herein.
Figure 1B:
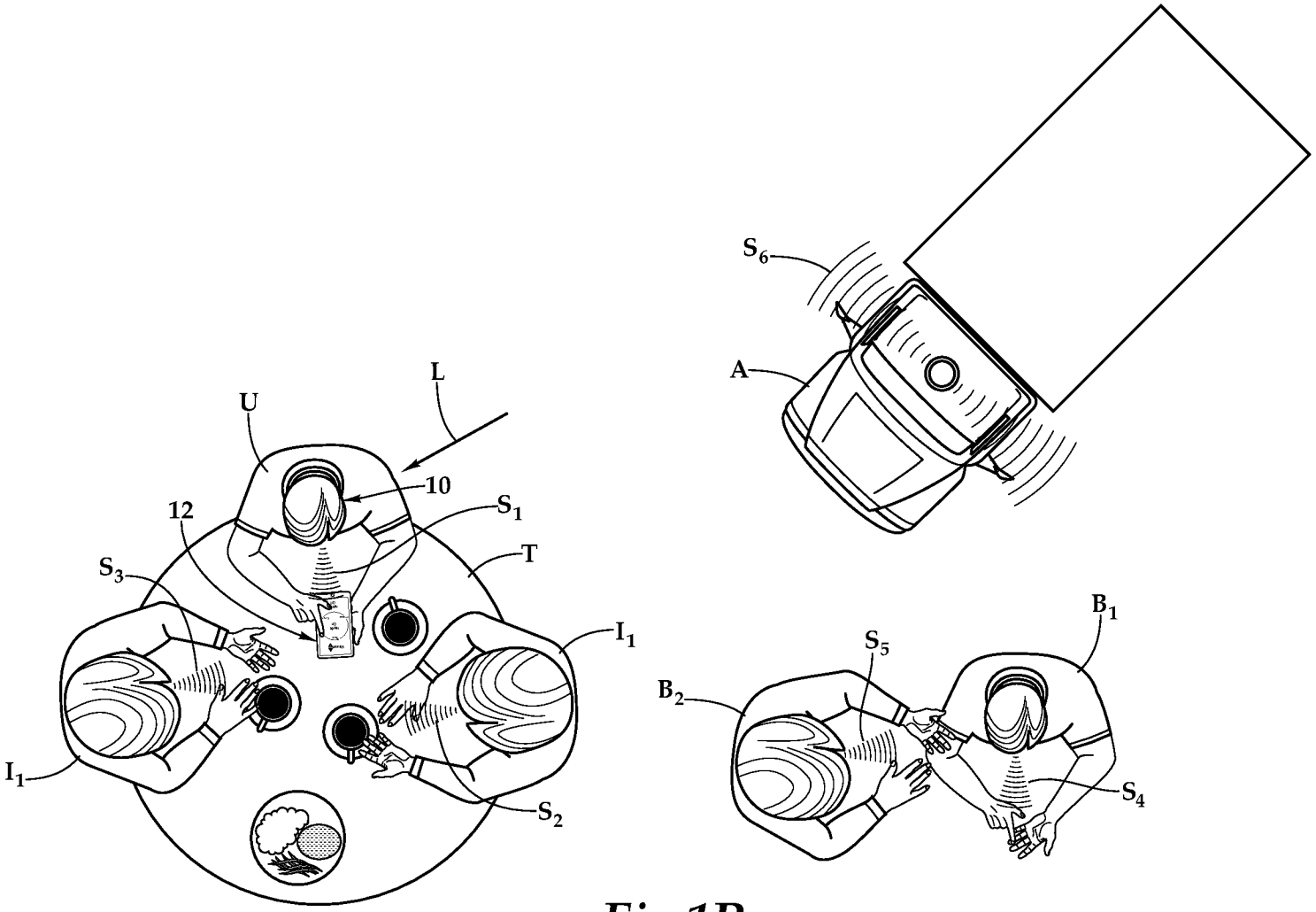
FIG. 1B is a top plan view depicting the hearing aid of FIG. 1A being utilized according to the teachings presented herein.

Referring initially to FIG. 1A and FIG. 1B, therein is depicted one embodiment of a hearing aid, which is schematically illustrated and designated 10. As shown, a user U, who may be considered a patient requiring a hearing aid, is wearing the hearing aid 10 and sitting at a table T at a restaurant or café, for example, and engaged in a conversation with an individual $I_1$ and an individual $I_2$. As part of a conversation at the table T, the user U is speaking sound $S_1$, the individual $I_1$ is speaking sound $S_2$, and the individual $I_2$ is speaking sound $S_3$. Nearby, in the background, a bystander $B_1$ is engaged in a conversation with a bystander $B_2$. The bystander $B_1$ is speaking sound $S_4$ and the bystander $B_2$ is speaking sound $S_5$. An ambulance A is driving by the table T and emitting sound $S_6$. The sounds $S_1$, $S_2$, and $S_3$ may be described as the immediate background sounds. The sounds $S_4$, $S_5$, and $S_6$ may be described as the background sounds. The sound $S_6$ may be described as the dominant sound as it is the loudest sound at table T.

As will be described in further detail hereinbelow, the hearing aid 10 is programmed with a qualified sound range for each ear in a two-ear embodiment and for one ear in a one-ear embodiment. As shown, in the two-ear embodiment, the qualified sound range may be a range of sound corresponding to a preferred hearing range for each ear of the user modified with a subjective assessment of sound quality according to the user. The preferred hearing range may be a range of sound corresponding to the highest hearing capacity of an ear of the user U between a range, which, by way of example, may be between 50 Hz and 10,000 Hz. Further, as shown, in the two-ear embodiment, the preferred hearing range for each ear may be multiple ranges of sound corresponding to the highest hearing capacity ranges of an ear of the user U between 50 Hz and 10,000 Hz. In some embodiments of this multiple range of sound implementation, the various sounds $S_1$ through $S_6$ received may be transformed and divided into the multiple ranges of sound. In particular, the preferred hearing range for each ear may be an about 300 Hz frequency to an about 500 Hz frequency range of sound corresponding to highest hearing capacity of a patient.

The subjective assessment according to the user may include a completed assessment of a degree of annoyance caused to the user by an impairment of wanted sound. The subjective assessment according to the user may also include a completed assessment of a degree of pleasantness caused to the patient by an enablement of wanted sound. That is, the subjective assessment according to the user may include a completed assessment to determine best sound quality to the user. Sound received at the hearing aid 10 is converted to the qualified sound range prior to output, which the user U hears.

In one embodiment, the hearing aid 10 has a dominant sound mode of operation 26, an immediate background mode of operation 28, and a background mode of operation 30 under the selective adjustment of the user U. In the dominant sound mode of operation 26, the hearing aid 10 identifies a loudest sound, such as the sound $S_6$, in the processed signal and increases a volume of the loudest sound in the signal being processed. In the immediate background mode of operation, the hearing aid 10 identifies sound in an immediate surrounding, such as the sounds $S_1$, $S_2$, and $S_3$ at the table T, to the hearing aid 10 and suppresses these sounds in the signal being processed. In the background mode of operation, the hearing aid 10 identifies extraneous ambient sound, such as the sounds $S_4$, $S_5$, and $S_6$, received at the hearing aid 10 and suppresses the extraneous ambient sounds in the signal being processed. Additionally, in the various modes of operation, the hearing aid 10 may identify the direction a particular sound is originating and express this direction in the two-ear embodiment, with appropriate sound distribution. By way of example, the ambulance A and the sound $S_6$ are originating on the left side of the user U and the sound is appropriately distributed at the hearing aid 10 to reflect this occurrence as indicated by an arrow L.

In one embodiment, the hearing aid 10 may create a pairing with a proximate smart device 12, such as a smart phone (depicted), smart watch, or tablet computer. The proximate smart device 12 includes a display 14 having an interface 16 having controls, such as an ON/OFF switch or volume controls 18 and mode of operation controls 20. A user may send a control signal wirelessly from the proximate smart device 12 to the hearing aid 10 to control a function, like volume controls 18, or to activate mode ON 22 or mode OFF 24 relative to one of the dominant sound modes of operation 26, the immediate background mode of operation 28, or the background mode of operation 30. It should be appreciated that the user U may activate other controls wirelessly from the proximate smart device 12. By way of example and not by way of limitation, other controls may include microphone input sensitivity adjusted per ear, speaker volume input adjusted per ear, the aforementioned background suppression for both ears, dominant sound amplification per ear, and ON/OFF. Further, in one embodiment, as shown by processor symbol P, after the hearing aid 10 creates the pairing with a proximate smart device 12, the hearing aid 10 and the proximate smart device 12 may leverage the wireless communication link therebetween and use processing distributed between the hearing aid 10 and the proximate smart device 12 to process the signals and perform other analysis.

Figure 2:
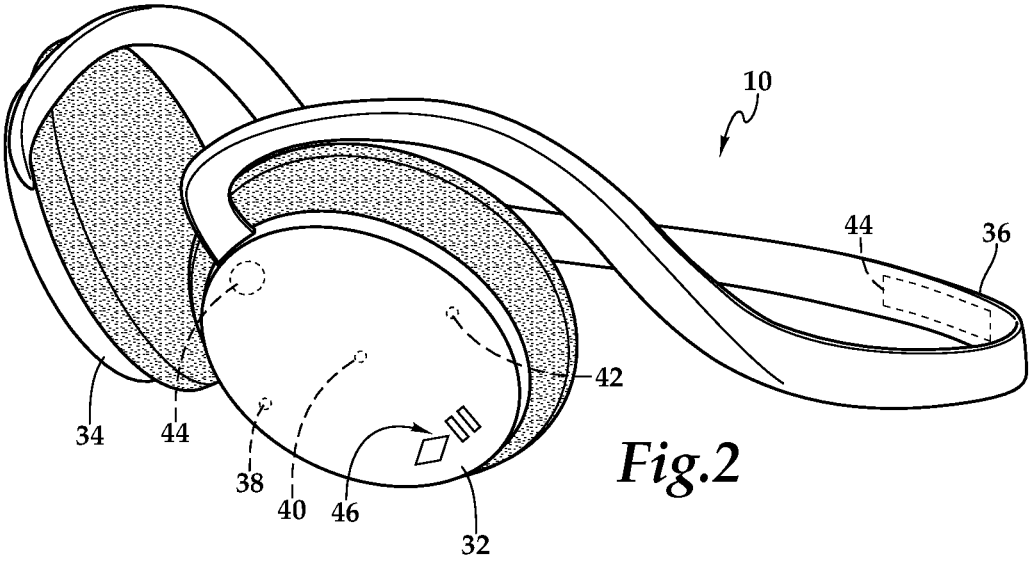
FIG. 2 is a front perspective view of one embodiment of the hearing aid depicted in FIG. 1.

Referring to FIG. 2, as shown, in the illustrated embodiment, the hearing aid 10 includes a left body 32 and a right body 34 connected to a band member 36 that is configured to partially circumscribe the user U. Each of the left body 32 and the right body 34 cover an external ear of the user U and are sized to engage therewith. In some embodiments, microphones 38, 40, 42, which gather sound directionally and convert the gathered sound into an electrical signal, are located on the left body 32. With respect to gathering sound, the microphone 38 may be positioned to gather forward sound, the microphone 40 may be positioned to gather lateral sound, and the microphone 42 may be positioned to gather rear sound. Microphones may be similarly positioned on the right body 34. Various internal compartments 44 provide space for housing electronics, which will be discussed in further detail hereinbelow. Various controls 46 provide a patient interface with the hearing aid 10.

Having each of the left body 32 and the right body 34 cover an external ear of the user U and being sized to engage therewith confers certain benefits. Sound waves enter through the outer ear and reach the middle ear to vibrate the eardrum. The eardrum then vibrates the oscilles, which are small bones in the middle ear. The sound vibrations travel through the oscilles to the inner ear. When the sound vibrations reach the cochlea, they push against specialized cells known as hair cells. The hair cells turn the vibrations into electrical nerve impulses. The auditory nerve connects the cochlea to the auditory centers of the brain. When these electrical nerve impulses reach the brain, they are experienced as sound. The outer ear serves a variety of functions. The various air-filled cavities composing the outer ear, the two most prominent being the concha and the ear canal, have a natural or resonant frequency to which they respond best. This is true of all air-filled cavities. The resonance of each of these cavities is such that each structure increases the sound pressure at its resonant frequency by approximately 10 to 12 dB. In summary, among the functions of the outer ear: a) boost or amplify high-frequency sounds; b) provide the primary cue for the determination of the elevation of a sound's source; c) assist in distinguishing sounds that arise from in front of the listener from those that arise from behind the listener. Headsets are used in hearing testing in medical and associated facilities for a reason: tests have shown that completely closing the ear canal in order to prevent any form of outside noise plays direct role in acoustic matching. The more severe hearing problem, the closer the hearing aid speaker must be to the ear drum. However, the closer to the speaker is to the ear drum, the more the device plugs the canal and negatively impacts the ear's pressure system. That is, the various chambers of the ear have a defined operational pressure determined, in part, by the ear's structure. By plugging the ear canal, the pressure system in the ear is distorted and the operational pressure of the ear is negatively impacted.

As alluded, "plug size" hearing aids having limitations with respect to distorting the defined operational pressure within the ear. Considering the function of the outer ear's air filled cavities in increasing the sound pressure at resonant frequencies, the hearing aid of FIG. 2—and other figures—creates a closed chamber around the ear increasing the pressure within the chamber. This higher pressure plus the utilization of a more powerful speaker within the headset at qualified sound range, e.g., the frequency range the user hears best with the best quality sound, provide the ideal set of parameters for a powerful hearing aid.

Figure 3A:
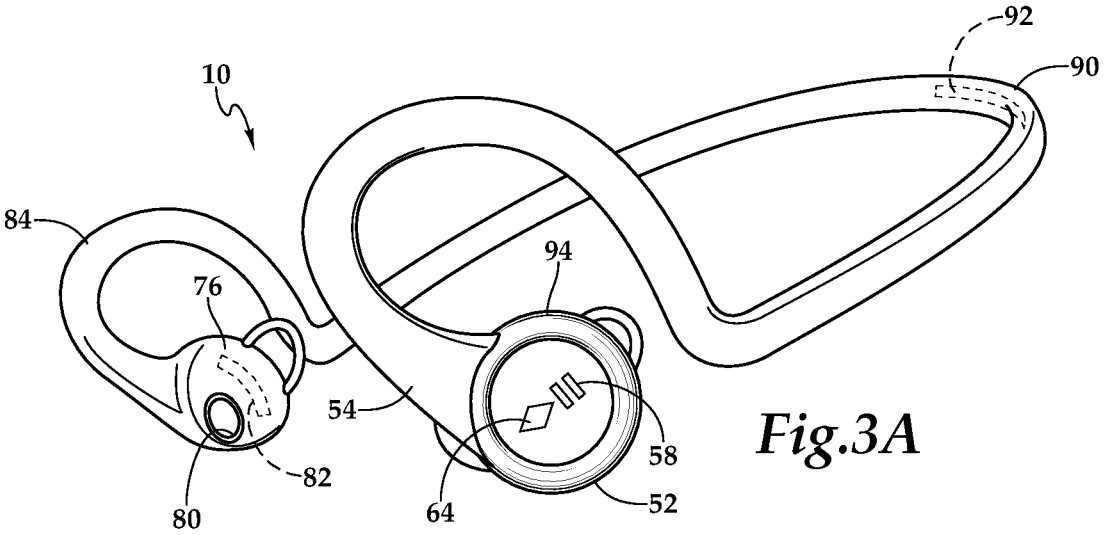
FIG. 3A is a front-left perspective view of another embodiment of the hearing aid depicted in FIG. 1.
Figure 3B:
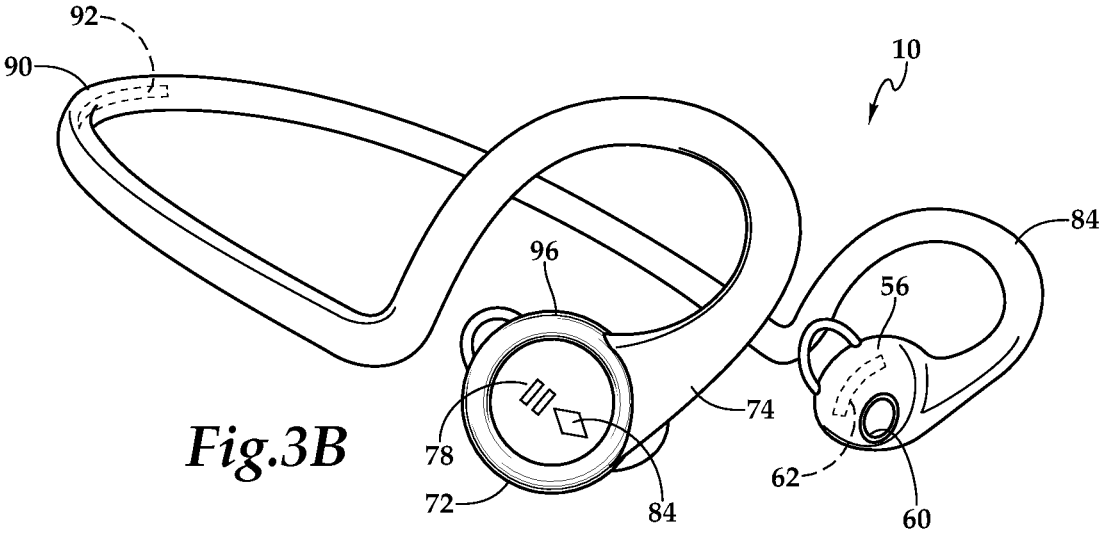
FIG. 3B is a front-right perspective view of the embodiment of the hearing aid depicted in FIG. 3A.

Referring to FIG. 3A and FIG. 3B, as shown, in the illustrated embodiment, the hearing aid 10 includes a left body 52 having an ear hook 54 extending from the left body 52 to an ear mold 56. The left body 52 and the ear mold 56 may each at least partially conform to the contours of the external ear and sized to engage therewith. By way of example, the left body 52 may be sized to engage with the contours of the ear in a behind-the-ear-fit. The ear mold 56 may be sized to be fitted for the physical shape of a patient's ear. The ear hook 54 may include a flexible tubular material that propagates sound from the left body 52 to the ear mold 56. Microphones 58, which gather sound and convert the gathered sound into an electrical signal, are located on the left body 52. An opening 60 within the ear mold 56 permits sound traveling through the ear hook 54 to exit into the patient's ear. An internal compartment 62 provides space for housing electronics, which will be discussed in further detail hereinbelow. Various controls 64 provide a patient interface with the hearing aid 10 on the left body 52 of the hearing aid 10.

As also shown, the hearing aid 10 includes a right body 72 having an ear hook 74 extending from the right body 72 to an ear mold 76. The right body 72 and the ear mold 76 may each at least partially conform to the contours of the external ear and sized to engage therewith. By way of example, the right body 72 may be sized to engage with the contours of the ear in a behind-the-ear-fit. The ear mold 76 may be sized to be fitted for the physical shape of a patient's ear. The ear hook 74 may include a flexible tubular material that propagates sound from the right body 72 to the ear mold 76. Microphones 78, which gather sound and convert the gathered sound into an electrical signal, are located on the right body 72. An opening 80 within the ear mold 76 permits sound traveling through the ear hook 74 to exit into the patient's ear. An internal compartment 82 provides space for housing electronics, which will be discussed in further detail hereinbelow. Various controls 84 provide a patient interface with the hearing aid 10 on the right body 72 of the hearing aid 10. It should be appreciated that the various controls 64, 84 and other components of the left and right bodies 52, 72 may be at least partially integrated and consolidated. Further, it should be appreciated that the hearing aid 10 may have one or more microphones on each of the left and right bodies 52, 72 to improve directional hearing in certain implementations and provide, in some implementations, 360-degree directional sound input.

In one embodiment, the left and right bodies 52, 72 are connected at the respective ear hooks 54, 74 by a band member 90 which is configured to partially circumscribe a head or a neck of the patient. A compartment 92 within the band member 90 may provide space for electronics and the like. Additionally, the hearing aid 10 may include left and right earpiece covers 94, 96 respectively positioned exteriorly to the left and right bodies 52, 72. Each of the left and right earpiece covers 94, 96 isolate noise to block out interfering outside noises. To add further benefit, in one embodiment, the microphones 58 in the left body 52 and the microphones 78 in the right body 72 may cooperate to provide directional hearing.

Figure 4:
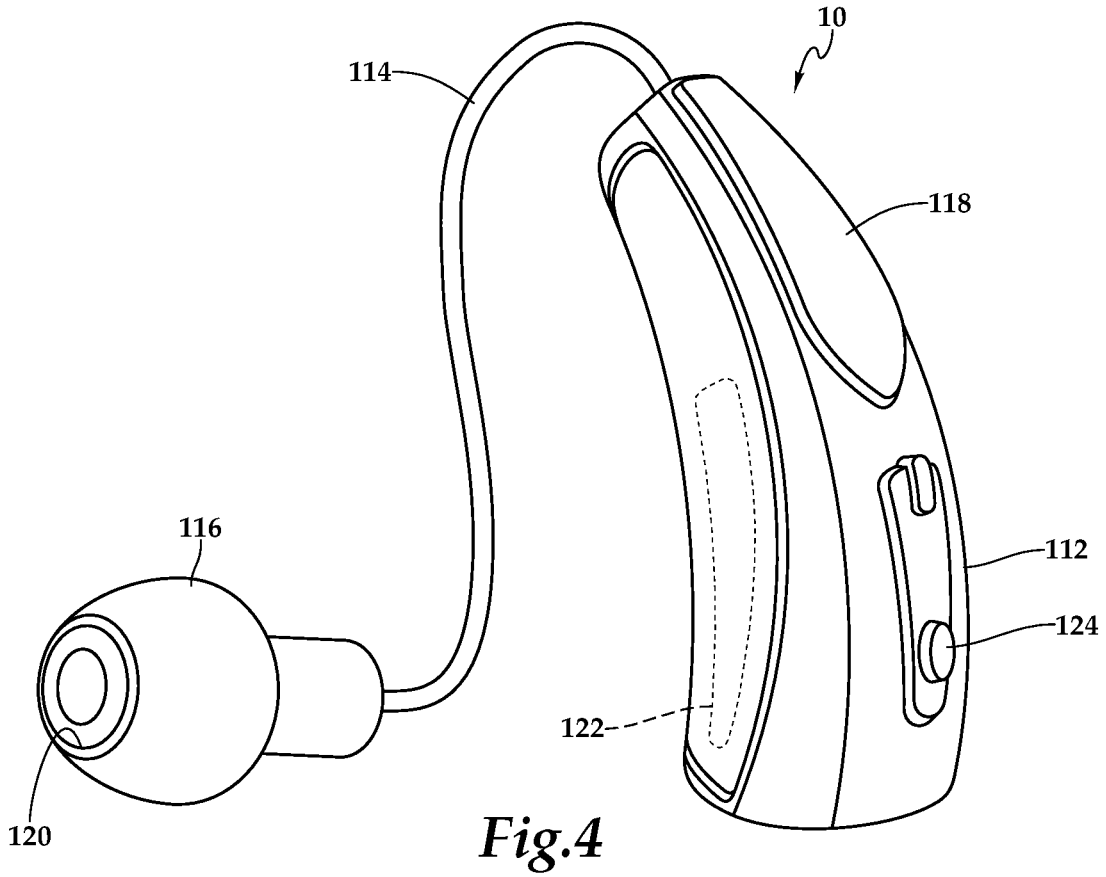
FIG. 4 is a front perspective view of another embodiment of a hearing aid according to the teachings presented herein.

Referring to FIG. 4, therein is depicted another embodiment of the hearing aid 10. As shown, in the illustrated embodiment, the hearing aid 10 includes a body 112 having an ear hook 114 extending from the body 112 to an ear mold 116. The body 112 and the ear mold 116 may each at least partially conform to the contours of the external ear and sized to engage therewith. By way of example, the body 112 may be sized to engage with the contours of the ear in a behind-the-ear-fit. The ear mold 116 may be sized to be fitted for the physical shape of a patient's ear. The ear hook 114 may include a flexible tubular material that propagates sound from the body 112 to the ear mold 116. A microphone 118, which gathers sound and converts the gathered sound into an electrical signal, is located on the body 112. An opening 120 within the ear mold 116 permits sound traveling through the ear hook 114 to exit into the patient's ear. An internal compartment 122 provides space for housing electronics, which will be discussed in further detail hereinbelow. Various controls 124 provide a patient interface with the hearing aid 10 on the body 112 of the hearing aid 10.

Figure 5:
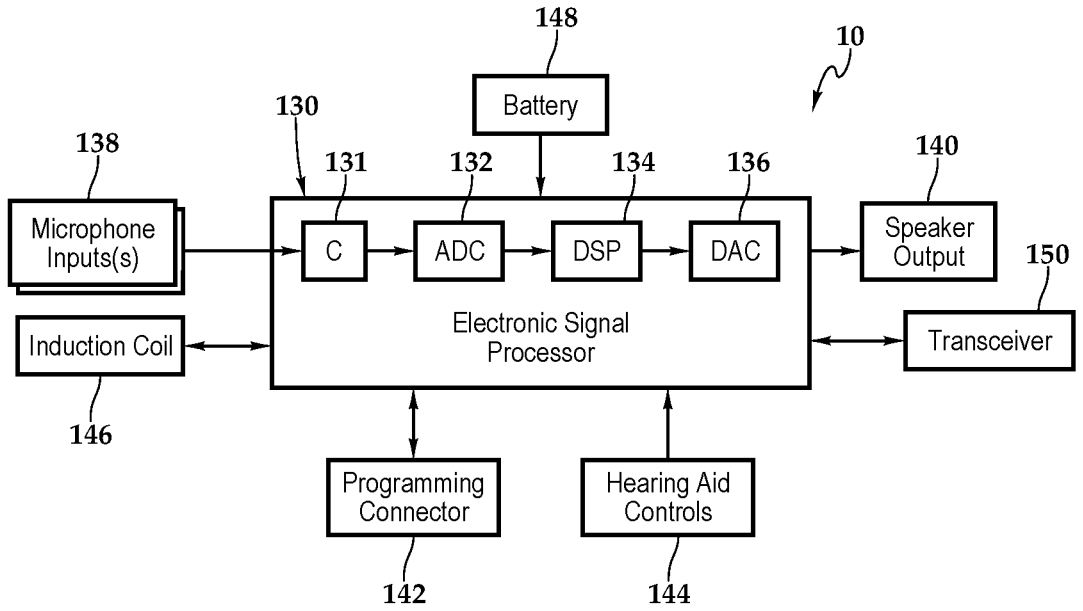
FIG. 5 is a functional block diagram depicting one embodiment of the hearing aid shown herein.

Referring now to FIG. 5, an illustrative embodiment of the internal components of the hearing aid 10 is depicted. By way of illustration and not by way of limitation, the hearing aid 10 depicted in the embodiment of FIG. 2 and FIGS. 3A, 3B is presented. It should be appreciated, however, that the teachings of FIG. 5 equally apply to the embodiment of FIG. 4. As shown, with respect to FIGS. 3A and 3B, in one embodiment, within the internal compartments 62, 82, an electronic signal processor 130 may be housed. The hearing aid 10 may include an electronic signal processor 130 for each ear or the electronic signal processor 130 for each ear may be at least partially integrated or fully integrated. In another embodiment, with respect to FIG. 4, within the internal compartment 122 of the body 112, the electronic signal processor 130 is housed. In order to measure, filter, compress, and generate, for example, continuous real-world analog signals in form of sounds, the electronic signal processor 130 may include an analog-to-digital converter (ADC) 132, a digital signal processor (DSP) 134, and a digital-to-analog converter (DAC) 136. The electronic signal processor 130, including the digital signal processor embodiment, may have memory accessible to a processor. One or more microphone inputs 138 corresponding to one or more respective microphones, a speaker output 140, various controls, such as a programming connector 142 and hearing aid controls 144, an induction coil 146, a battery 148, and a transceiver 150 are also housed within the hearing aid 10.

As shown, a signaling architecture communicatively interconnects the microphone inputs 138 to the electronic signal processor 130 and the electronic signal processor 130 to the speaker output 140. The various hearing aid controls 144, the induction coil 146, the battery 148, and the transceiver 150 are also communicatively interconnected to the electronic signal processor 130 by the signaling architecture. The speaker output 140 sends the sound output to a speaker or speakers to project sound and in particular, acoustic signals in the audio frequency band as processed by the hearing aid 10. By way of example, the programming connector 142 may provide an interface to a computer or other device. The hearing aid controls 144 may include an ON/OFF switch as well as volume controls, for example. The induction coil 146 may receive magnetic field signals in the audio frequency band from a telephone receiver or a transmitting induction loop, for example, to provide a telecoil functionality. The induction coil 146 may also be utilized to receive remote control signals encoded on a transmitted or radiated electromagnetic carrier, with a frequency above the audio band. Various programming signals from a transmitter may also be received via the induction coil 146 or via the transceiver 150, as will be discussed. The battery 148 provides power to the hearing aid 10 and may be rechargeable or accessed through a battery compartment door (not shown), for example. The transceiver 150 may be internal, external, or a combination thereof to the housing. Further, the transceiver 150 may be a transmitter/receiver, receiver, or an antenna, for example. Communication between various smart devices and the hearing aid 10 may be enabled by a variety of wireless methodologies employed by the transceiver 150, including 802.11, 3G, 4G, Edge, WiFi, ZigBee, near field communications (NFC), Bluetooth low energy, and Bluetooth, for example.

The various controls and inputs and outputs presented above are exemplary and it should be appreciated that other types of controls may be incorporated in the hearing aid 10. Moreover, the electronics and form of the hearing aid 10 may vary. The hearing aid 10 and associated electronics may include any type of headphone configuration, a behind-the-ear configuration, an in-the-ear configuration, or in-the-ear configuration, for example. Further, as alluded, electronic configurations with multiple microphones for directional hearing are within the teachings presented herein. In some embodiments, the hearing aid has an over-the-ear configuration where the entire ear is covered, which not only provides the hearing aid functionality but hearing protection functionality as well.

Continuing to refer to FIG. 5, in one embodiment, the electronic signal processor 130 may be programmed with a preferred hearing range which, in one embodiment, is the preferred hearing sound range corresponding to highest hearing capacity of a patient. In one embodiment, the left ear preferred hearing range and the right ear preferred hearing range are each a range of sound corresponding to highest hearing capacity of an ear of a patient between, by way of example, a variable range, such as between 50 Hz and 10,000 Hz. The preferred hearing range for each of the left ear and the right ear may be an about 300 Hz frequency to an about 500 Hz frequency range of sound.

With this approach, the hearing capacity of the patient is enhanced. Existing audiogram hearing aid industry testing equipment measures hearing capacity at defined frequencies, such as 60 Hz; 125 Hz; 250 Hz; 500 Hz; 1,000 Hz; 2,000 Hz; 4,000 Hz; 8,000 Hz and existing hearing aids work on a ratio-based frequency scheme. The present teachings however measure hearing capacity at a small step, such as 5 Hz, 10 Hz, or 20 Hz. Thereafter, one or a few, such as three, frequency ranges are defined to serve as the preferred hearing range or preferred hearing ranges. As discussed herein, in some embodiments of the present approach, a two-step process is utilized. First, hearing is tested in an ear within a range, such as between 50 Hz and 5,000 Hz, for example, at a variable increment, such as a 50 Hz increment or other increment, and between 5,000 Hz and 10,0000 Hz at a variable increment, such as a 200 Hz increment or other increment, to identify potential hearing ranges. Then, in the second step, the testing may be switched to a 5 Hz, 10 Hz, or 20 Hz increment to precisely identify the preferred hearing range.

Further, in one embodiment, with respect to FIG. 4, the various controls 124 may include an adjustment that widens the about frequency range of about 200 Hz, for example, to a frequency range of 100 Hz to 700 Hz or even wider, for example. Further, the preferred hearing sound range may be shifted by use of various controls 124. Directional microphone systems on each microphone position and processing may be included that provide a boost to sounds coming from the front of the patient and reduce sounds from other directions. Such a directional microphone system and processing may improve speech understanding in situations with excessive background noise. Digital noise reduction, impulse noise reduction, and wind noise reduction may also be incorporated. As alluded to, system compatibility features, such as FM compatibility and Bluetooth compatibility, may be included in the hearing aid 10.

The processor may process instructions for execution within the electronic signal processor 130 as a computing device, including instructions stored in the memory. The memory stores information within the computing device. In one implementation, the memory is a volatile memory unit or units. In another implementation, the memory is a non-volatile memory unit or units. The memory is accessible to the processor and includes processor-executable executable instructions that, when executed, cause the processor to execute a series of operations. The processor-executable instructions cause the processor to receive an input analog signal from the microphone inputs 138 and convert the input analog signal to a digital signal. In one implementation, as part of the conversion from the input analog signal to a digital signal, the input analog signal is modified with a subjective assessment of sound quality according to the patient at a converter 131. The processor-executable instructions then cause the processor to transform through compression, for example, the digital signal into a processed digital signal having the subjective assessment of sound quality according to the patient. If should be appreciated that at this step, in one embodiment, the digital signal may be modified with a subjective assessment of sound quality according to the patient, if such a modification has not already occurred. The processed digital signal is then transformed into the preferred hearing range. The transformation may be a frequency transformation where the input frequency is frequency transformed into the preferred hearing range. Such a transformation is a toned-down, narrower articulation that is clearly understandable as it is customized for the user. The processor is then caused by the processor-executable instructions to convert the processed digital signal to an output analog signal, which may be amplified as required, and drive the output analog signal to the speaker output 140. Essentially, in one embodiment, utilizing a single algorithm an analog sound is converted by way of the subjective assessment of sound quality according to the user. The signal is then transferred into the preferred hearing range prior to a digital-to-analog conversion and amplification.

The memory that is accessible to the processor may include additional processor-executable instructions that, when executed, cause the processor to execute a series of operations. The processor-executable instructions may cause the processor to receive a control signal to control volume or another functionality. The processor-executable instructions may also receive a control signal and cause the activation of one of a dominant sound mode of operation 26, an immediate background mode of operation 28, and a background mode of operation 30. The various modes of operation, including the dominant sound mode of operation 26, the immediate background mode of operation 28, and the background mode of operation 30, may be implemented on a per ear basis or for both ears.

These processor-executable instructions may also cause the processor to create a pairing via the transceiver 150 with a proximate smart device 12. The processor-executable instructions may then cause the processor to receive a control signal from the proximate smart device to control volume or another functionality. The processor-executable instructions may then receive a control signal and cause the activation of one of a dominant sound mode of operation 26, an immediate background mode of operation 28, and a background mode of operation 30.

In another implementation, the processor-executable instructions may cause the processor to receive an input analog signal from the microphone inputs 138 and convert the input analog signal to a digital signal modified with a subjective assessment of sound quality according to the user. The processor then transforms through compression the digital signal into a processed digital signal having the preferred hearing range. In the dominant sound mode of operation 26, the processor is caused to identify a loudest sound in the processed digital signal and increase a volume of the loudest sound in the processed digital signal. The processor is then caused, in the immediate background mode of operation 28, to identify sound in an immediate surrounding to the hearing aid 10 and suppress the sound in the processed digital signal. In the background mode of operation 30, the processor is caused to identify extraneous ambient sound received at the hearing aid 10 and suppress the extraneous ambient sound in the processed digital signal. Further, the processor may be caused to convert the processed digital signal to an output analog signal and drive the output analog signal to the speaker.

In other implementations, the processor-executable instructions may cause the processor to create a pairing via the transceiver 150 with the proximate smart device 12. Then, the processor-executable instructions may cause the processor to receive an input analog signal from the microphone and convert the input analog signal to a digital signal. The processor may then be caused to transform through compression with distributed computing between the processor and the proximate smart device 12, the digital signal into a processed digital signal having the preferred hearing range modified with a subjective assessment of sound quality according to the user to provide the qualified sound range. At the processor within the hearing aid, the processor-executable instructions cause the processor to convert the processed digital signal to an output analog signal and drive the output analog signal to the speaker. The left ear preferred hearing range and the right ear preferred hearing range may comprise a frequency transfer component, a sampling rate component, a cut-off harmonics component, an additional harmonics component, and/or a harmonics transfer component. Further, the processor-executable instructions may cause the processor to process a frequency transfer component, a sampling rate component, a cut-off harmonics component, an additional harmonics component, and/or a harmonics transfer component.

In another implementation, the processor-executable instructions may cause the processor to receive an input analog signal from the microphone inputs and convert the input analog signal to a digital signal modified with a subjective assessment of sound quality according to the user. The processor then transforms the digital signal into a processed digital signal having a preferred hearing range. The preferred hearing range may be one or more ranges of sound corresponding to the highest hearing capacity of an ear of the patient. As mentioned, to provide the qualified sound range, the preferred hearing range may be modified with a subjective assessment of sound quality according to the patient. The subjective assessment of sound quality according to the patient may be a completed assessment of a degree of annoyance caused to the patient by an impairment of wanted sound. The preferred hearing range may be modified with enhanced harmonics, including a cut-off harmonics component, an additional harmonics component, or a harmonics transfer component, for example. The processor-executable instructions may also cause the processor to convert the processed digital signal to an output analog signal and drive the output analog signal to the speaker. It should be appreciated that the processor-executable instructions may cause the processor to utilize the transceiver to utilize distributed processing between the hearing aid and the proximate smart device to transform through compression the digital signal into a processed digital signal having the preferred hearing range with harmonics enhancement.

Figure 6:
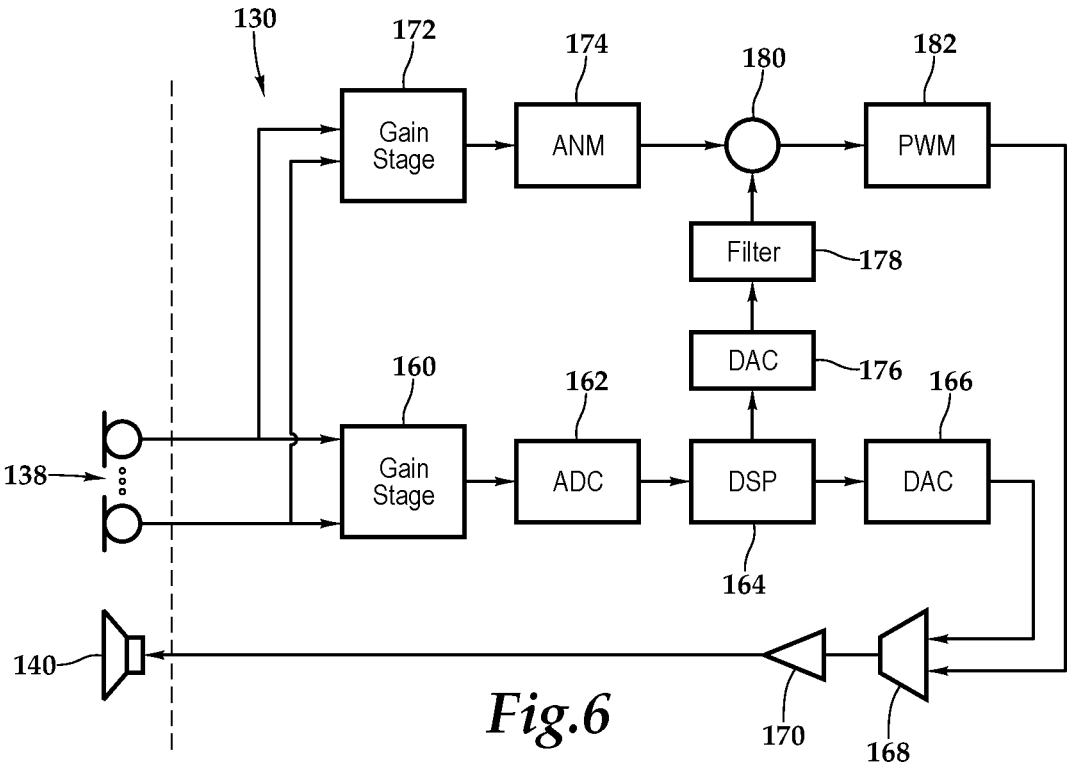
FIG. 6 is a functional block diagram depicting another embodiment of the hearing aid shown herein.

Referring now to FIG. 6, in one embodiment, the electronic signal processor 130 receives a signal from the one or more microphone inputs 138 and outputs a signal to the speaker output 140. The electronic signal processor 130 includes a gain stage 160 that receives the electronic signal from the microphone inputs 138 and amplifies the signal. The gain stage 160 forwards the signal to an analog-to-digital converter (ADC) 162, which converts the amplified analogue electronic signal to a digital electronic signal. The gain stage 260, in one embodiment, is a point during an audio signal flow that adjustments may be made to the audio signal prior to conversion by the analog-to-digital converter (ADC) 162. The gain stage may include a modification of the signal to accommodate a subjective assessment of sound quality according to the user or patient. A digital signal processor (DSP) 164 receives the digital electronic signal from the ADC 162 and is configured to process the digital electronic signal with the desired compensation based on the qualified sound range, which includes the preferred hearing range, which is stored therein, and may include the subjective assessment of sound quality according to the user.

The DSP 164 may cancel or reduce—or augment or increase—the ambient noise to support the desired dominant sound mode of operation 26, immediate background mode of operation 28, or background mode of operation 30 by utilizing an algorithm. Such an algorithm may examine modulation characteristics of the speech envelope, such as harmonic structure, modulation depth, and modulation count. Based on these characteristics, various triggers may be defined that describe wanted versus unwanted background noise as well as immediate noise. The sound may then be altered digitally. It should be appreciated that other digital noise reduction and gain techniques may be utilized, including algorithms incorporating adaptive beamforming and adaptive optimal filtering processing.

The processed digital electronic signal is then driven to a digital-to-analog converter (DAC) 166, which converts the processed digital electronic signal to a processed analog electronic signal that is then driven to a multiplexer 168 and onto a low output impedance output driver 170 prior to output, at the speaker output 140. A gain stage 172 receives the electronic signal from the microphone inputs 138 and amplifies the analog electronic signal prior to driving the signal to an active noise modulation (ANM) unit 174, which is configured to perform active noise suppression or active noise augmentation by way of various amplifiers and filters. Another signal path includes the DSP 164 providing the processed digital electronic signal to a DAC 176 and a filter 178. The ANM-driven signal and filter-driven signal are combined at the combiner unit 180 prior to be provided to a pulse width modulator (PWM) 182 prior to the signal being driven to the multiplexer 168. In this manner the ANM-driven signal may cancel or reduce—or augment or increase—the ambient noise to provide the desired dominant sound mode of operation 26, immediate background mode of operation 28, or background mode of operation 30 while the DSP-driven signal corrects the input signal to compensate for hearing loss according to the qualified sound range.

Figure 7:
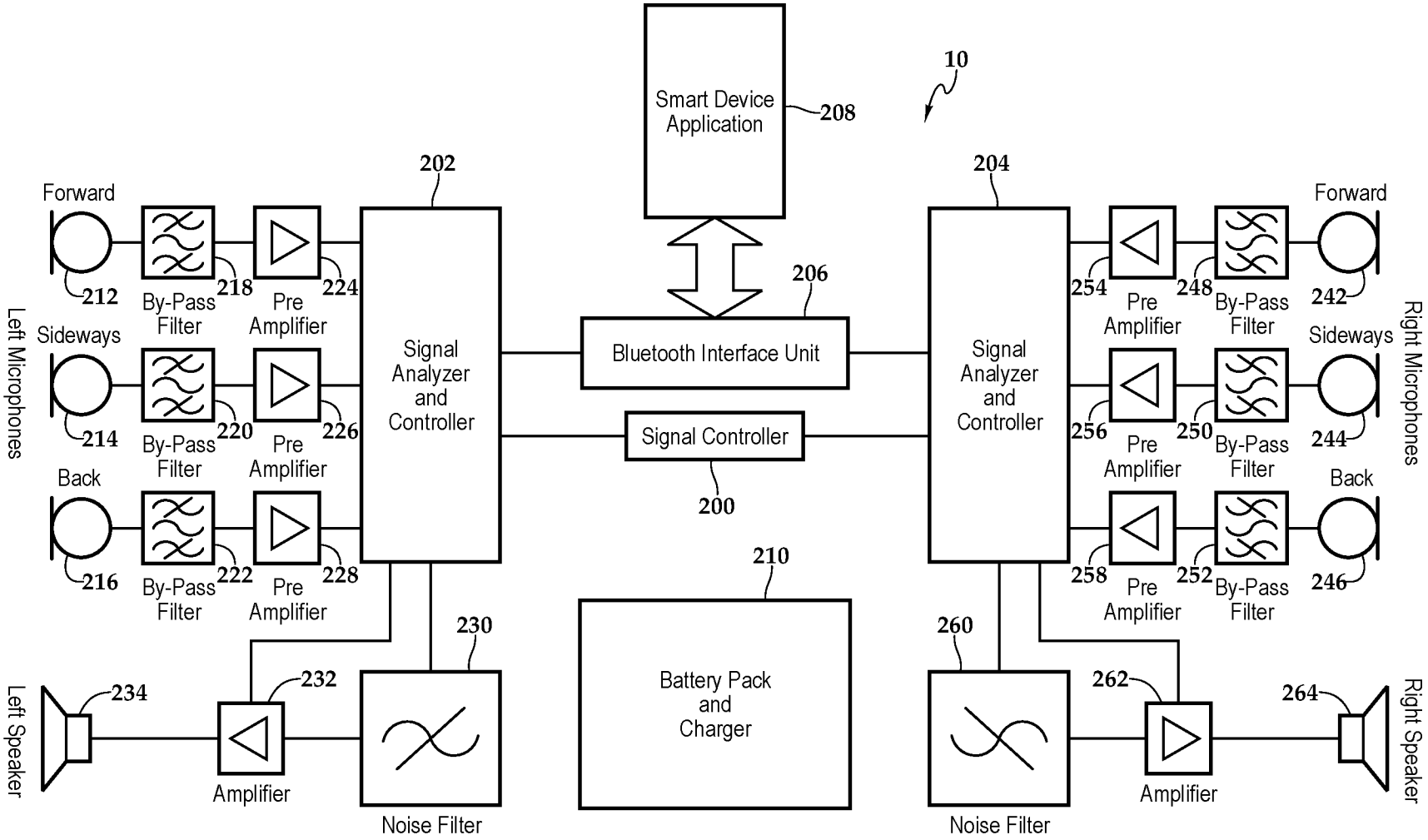
FIG. 7 is a functional block diagram depicting a further embodiment of the hearing aid shown herein.

Referring now to FIG. 7, in one embodiment of the hearing aid 10, a signal controller 200 is centrally located in communication with a signal analyzer and controller 202 serving the left side of the hearing aid 10 and with a signal analyzer and controller 204 serving the right side of the hearing aid 10. A Bluetooth interface unit 206 is also in communication with the signal analyzer and controller 202 and with the signal analyzer and controller 204. The Bluetooth interface unit 206 is located in communication with a smart device application 208 that may be installed on a smart device, such as a smart phone or smart watch. A battery pack and charger 210 serves the hearing aid 10 with power.

With respect to the left microphones, a forward microphone 212, a sideways-facing microphone 214, and a back microphone 216 are respectfully connected in series to by-pass filters 218, 220, 222, which in turn are respectfully connected in series to pre-amplifiers 224, 226, 228 connected to the signal analyzer and controller 202. Similarly, with respect to the right microphones, a forward microphone 242, a sideways-facing microphone 244, and a back microphone 246 are respectfully connected in series to by-pass filters 248, 250, 252, which in turn are respectfully connected in series to pre-amplifiers 254, 256, 258 connected to the signal analyzer and controller 204.

The signal analyzer and controller 202 is connected in parallel to a noise filter 230 and an amplifier 232, which also receives a signal from the noise filter 230. The amplifier 232 drives a signal to the left speaker 234. Similarly, the signal analyzer and controller 204 is connected in parallel to a noise filter 260 and an amplifier 262, which also receives a signal from the noise filter 260. The amplifier 262 drives a signal to the right speaker 264. As previously alluded, each of the signal analyzer and controllers 202, 204 transfers the live sound frequency into a qualified sound range including a frequency range or frequency ranges that the person using the hearing aid 10 hears through, in some embodiments, a combination of frequency transfer, sampling rate, cut-off harmonics, additive harmonics, and harmonic transfer. The qualified sound range also includes a modification of the sound based on a subjective assessment of sound quality. Also, each of the signal analyzer and controllers 202, 204 may determine a direction of the sound source.

Figure 8:
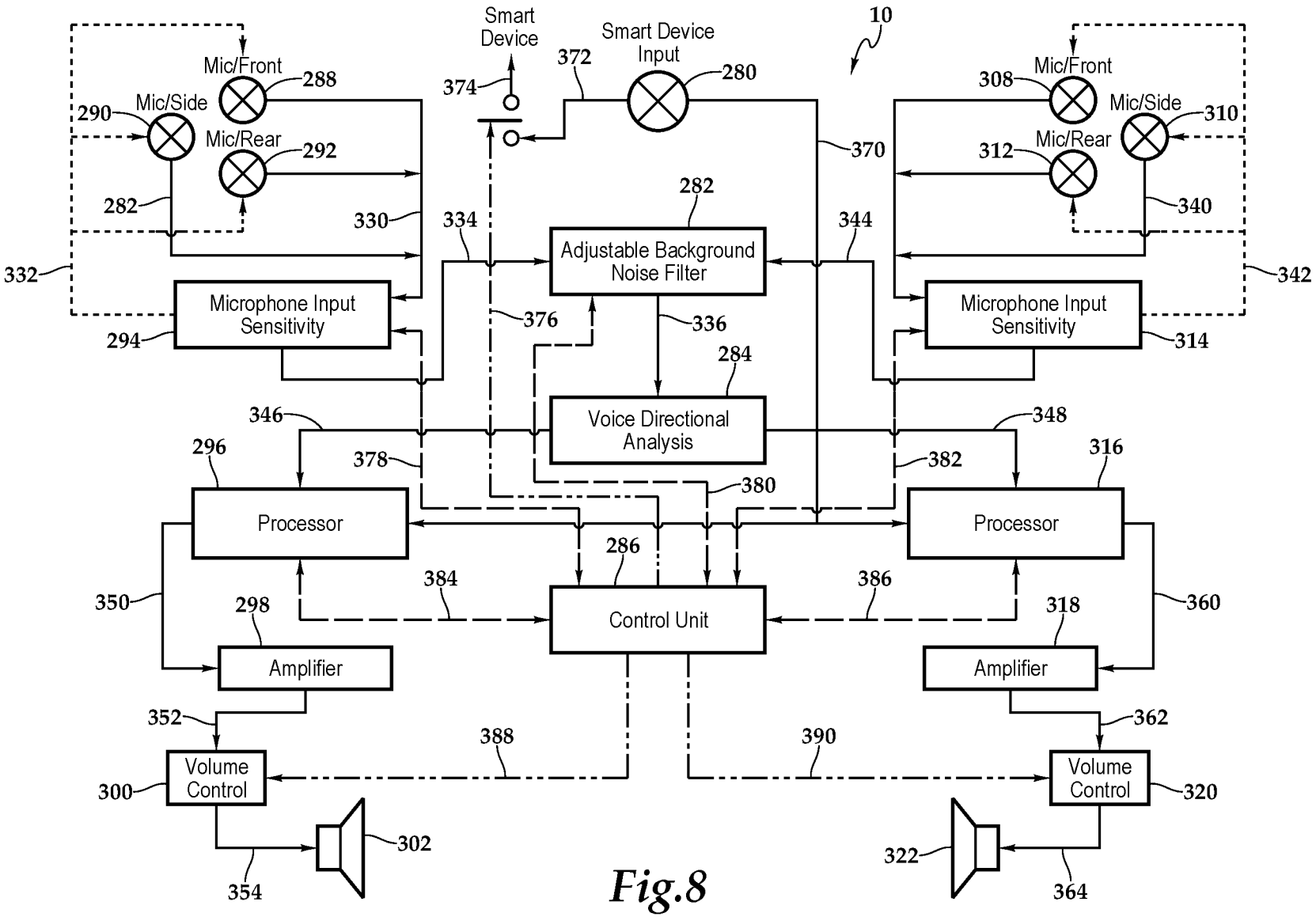
FIG. 8 is a functional block diagram a still further embodiment of the hearing aid shown herein.

Referring now to FIG. 8, in one embodiment of the hearing aid 10, a smart device input 280, an adjustable background noise filter 282, a voice directional analysis module 284, and a control unit 286 are interconnected. A front microphone 288, a side microphone 290, and a rear microphone 292 are connected to a microphone input sensitivity module 294. A processor 296, an amplifier 298, volume control 300, and a speaker 302 are also provided. On the other side, a front microphone 308, a side microphone 310, and a rear microphone 312 are connected to a microphone input sensitivity module 314. A processor 316, an amplifier 318, volume control 320, and a speaker 322 are also provided.

With respect to signaling, on a first side of the hearing aid 10, the front microphone 288, the side microphone 290, and the rear microphone 292 provide a direct signal 330 to the microphone input sensitivity module 294, which provides a feedback signal 332. The direct signal 330 and the feedback signal 332 provide for the regulation of the input volume at the front microphone 288, the side microphone 290, and the rear microphone 292. The microphone input sensitivity module 294, in turn, provides a direct signal 334 to the adjustable background noise filter 282. A direct signal 336 is provided to the voice directional analysis module 284.

On a second side of the hearing aid 10, the front microphone 308, the side microphone 310, and the rear microphone 312 provide a direct signal 340 to the microphone input sensitivity module 314, which provides a feedback signal 342. The direct signal 340 and the feedback signal 342 provide for the regulation of the input volume at the front microphone 308, the side microphone 310, and the rear microphone 312. The microphone input sensitivity module 314, in turn, provides a direct signal 344 to the adjustable background noise filter 282.

The voice directional analysis 284, which determines the direction of origin of sound received by the front microphone 288, the side microphone 290, the rear microphone 292, the front microphone 308, the side microphone 310, and the rear microphone 312, provides a direct signal 346 to the processor 296 and a direct signal 348 to the processor 316. The processor 296 is associated with the speaker 302 and provides a direct signal 350 to the amplifier 298, which provides a direct signal 352 to the volume control 300. A direct signal 354 is then provided to the speaker 302. The speaker 302 is physically positioned on the same ear as the front microphone 288, the side microphone 290, and the rear microphone 292.

On the other hand, the processor 316 is associated with the speaker 322 and provides a direct signal 360 to the amplifier 318, which provides a direct signal 362 to the volume control 320. A direct signal 364 is then provided to the speaker 322. The speaker 322 is physically positioned on the same ear as the front microphone 308, the side microphone 310, and the rear microphone 312.

In applications where the smart device input 280 is utilized, the smart device input 280 provides a direct signal 370 to each of the processors 296, 316. A direct signal 372 is also provided by the smart device input 280 to the smart device by way of connection 374, which is under the direct control of the control unit 286 by way of a direct control signal 376. Continuing with the discussion of the control unit 286, a bi-directional interface 378 operates between the control unit 286 and the microphone input sensitivity module 294. Similarly, a bi-directional interface 380 operates between the control unit 286 and the adjustable background noise filter 282. A bi-directional interface 382 operates between the control unit 286 and the microphone input sensitivity module 314 that services the front microphone 308, the side microphone 310, and the rear microphone 312.

The control unit 286 and the processor 296 share a bi-directional interface 384 and the control unit 286 and the processor 316 share a bi-directional interface 386. The control unit 286 provides direct control over the volume control 300 associated with the speaker 302 and the volume control 320 associated with the speaker 322 via respective direct control signals 388, 390.

Figure 9:
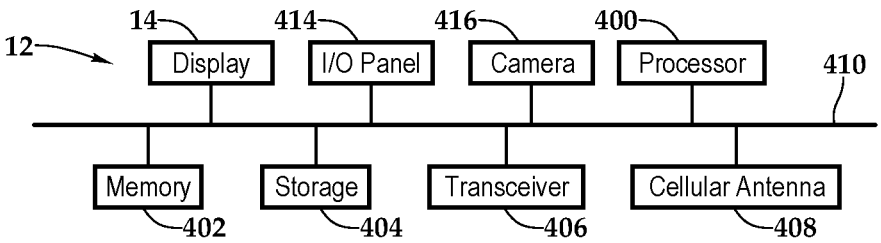
FIG. 9 is a functional block diagram depicting one embodiment of a smart device shown in FIG. 1, which may form a pairing with the hearing aid.

Referring now to FIG. 9, the proximate smart device 12 may be a wireless communication device of the type including various fixed, mobile, and/or portable devices. To expand rather than limit the discussion of the proximate smart device 12, such devices may include, but are not limited to, cellular or mobile smart phones, tablet computers, smartwatches, and so forth. The proximate smart device 12 may include a processor 400, memory 402, storage 404, a transceiver 406, and a cellular antenna 408 interconnected by a busing architecture 410 that also supports the display 14, I/O panel 414, and a camera 416. It should be appreciated that although a particular architecture is explained, other designs and layouts are within the teachings presented herein.

In operation, the teachings presented herein permit the proximate smart device 12 such as a smart phone to form a pairing with the hearing aid 10 and operate the hearing aid 10. As shown, the proximate smart device 12 includes the memory 402 accessible to the processor 400 and the memory 402 includes processor-executable instructions that, when executed, cause the processor 400 to provide an interface for an operator that includes an interactive application for viewing the status of the hearing aid 10. The processor 400 is caused to present a menu for controlling the hearing aid 10. The processor 400 is then caused to receive an interactive instruction from the user and forward a control signal via the transceiver 406, for example, to implement the instruction at the hearing aid 10. The processor 400 may also be caused to generate various reports about the operation of the hearing aid 10. The processor 400 may also be caused to translate or access a translation service for the audio.

In a still further embodiment of processor-executable instructions, the processor-executable instructions cause the processor 400 to provide an interface for the user U of the hearing aid 10 to select a mode of operation. In one embodiment, as discussed, the hearing aid 10 has the dominant sound mode of operation 26, the immediate background mode of operation 28, and the background mode of operation 30. As previously discussed, in the dominant sound mode of operation 26, the hearing aid 10 identifies a loudest sound in the processed digital signal and increases a volume of the loudest sound in the signal being processed. In the immediate background mode of operation 28, the hearing aid 10 identifies sound in an immediate surrounding to the hearing aid 10 and suppresses the sound in the signal being processed. In the background mode of operation 30, the hearing aid 10 identifies extraneous ambient sound received at the hearing aid 10 and suppresses the extraneous ambient sound in the signal being processed.

In a still further embodiment of processor-executable instructions, the processor-executable instructions cause the processor 400 to create a pairing via the transceiver 406 with the hearing aid 10. Then, the processor-executable instructions may cause the processor 400 to transform through compression with distributed computing between the processor 400 and the hearing aid 10, the digital signal into a processed digital signal having the qualified sound range, which includes the preferred hearing range as well as the subjective assessment of sound quality. The left ear preferred hearing range and the right ear preferred hearing range may comprise a frequency transfer component, a sampling rate component, a cut-off harmonics component, an additional harmonics component, and/or a harmonics transfer component. Further, the processor-executable instructions may cause the processor 400 to process a frequency transfer component, a sampling rate component, a cut-off harmonics component, an additional harmonics component, and/or a harmonics transfer component. The subjective assessment according to the user may include a completed assessment of a degree of annoyance caused to the user by an impairment of wanted sound. The subjective assessment according to the user may also include a completed assessment of a degree of pleasantness caused to the patient by an enablement of wanted sound. That is, the subjective assessment according to the user may include a completed assessment to determine best sound quality to the user.

Further still, the processor-executable instructions cause the processor 400 to create the pairing via the transceiver 406 with the hearing aid 10 and cause the processor 400 to transform through compression with distributed computing between the processor 400 and the hearing aid 10, the digital signal into a processed digital signal having the qualified sound range including the preferred hearing range and subjective assessment of sound quality. The preferred hearing range may be a range or ranges of sound corresponding to highest hearing capacity of an ear of a patient modified with a subjective assessment of sound quality according to the patient. The preferred hearing range may further include harmonics, such as a cut-off harmonics component, an additional harmonics component, or a harmonics transfer component, for example. The preferred hearing range may also include a frequency transfer component, a sampling rate component, a signal amplification component. The subjective assessment according to the user may include a completed assessment of a degree of annoyance caused to the user by an impairment of wanted sound. The subjective assessment according to the user may also include a completed assessment of a degree of pleasantness caused to the patient by an enablement of wanted sound. That is, the subjective assessment according to the user may include a completed assessment to determine best sound quality to the user.

Figure 10:
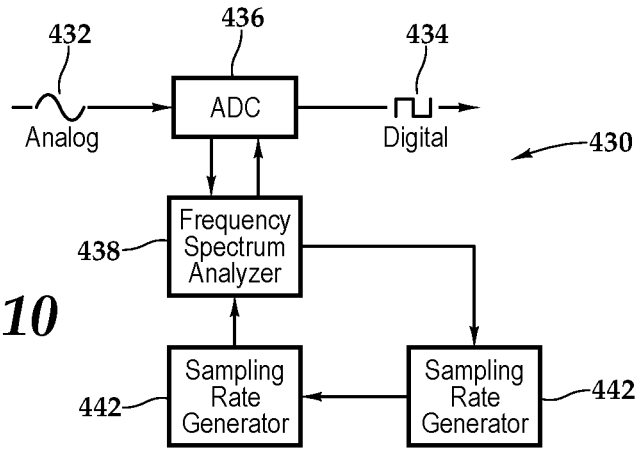
FIG. 10 is a functional block diagram depicting one embodiment of sampling rate processing, according to the teachings presented herein.

Referring now to FIG. 10, in some embodiments, a sampling rate circuit 430, which may form a portion of the hearing aid 10 may have an analog signal 432 as an input and a digital signal 434 as an output. More particularly, an analog-to-digital converter (ADC) 436 receives the analog signal 432 and a signal from a frequency spectrum analyzer 438 as inputs. The ADC 436 provides outputs including the digital signal 434 and a signal to the frequency spectrum analyzer 438. The frequency spectrum analyzer 438 forms a feedback loop with a sampling rate controller 442 and a sampling rate generator 444. As shown, the frequency spectrum analyzer 438 analyzes the range of one received analog signal 432 and through the feedback loop using the sampling rate controller 442 and sampling rate generator 444 the sampling rage at the ADC 426 is optimized.

By way of further explanation, with respect to sampling rate (SR), total sound $S_T$ may be defined as follows:

$S_T=F_B+H_1+H_2+\ldots+H_N$, wherein:

$S_T$=Total Sound;

$F_B$=Base Frequency;

$H_1=1^{st}$ Harmonic;

$H_2=2^{nd}$ Harmonic; and $H_N=N^{th}$ Harmonic, where H is the mathematical multiplication of $F_B$.

That is, total sound $S_T$ is the sum of cardinal sound (CS) and an N stage of Background Noise (BN), such that the following applies:

$S_T=CS+BN_G+BN_I$, wherein:

$BN_G$=general background noise;

$BN_I$=immediate background noise; and

CS=highest amplitude sound within a defined timeframe.

Within this framework, differentiation of the number of background noise (BN) stages is matter of decision, not matter of structural change.

Therefore, with respect to sampling rate (SR), the following applies:

SR=N×highest frequency that the filter from $S_T=F_B+H_1+H_2\ldots+H_N$ will allow.

In this manner, the hearing aid sampling rate (SR) may be designed to be between 1 kHz-40 kHz; however, the range may be modified based on application. The sampling rate (SR) change may be controlled by the ratio between the cardinal sound (CS) and background noise (BN) received in the analog signal 432. The sampling rate circuit 430 provides a high accuracy of optimization of the base frequency ($F_B$) and harmonics ($H_1, H_2, \ldots, H_N$) components of the cardinal sound (CS) as well as the base frequency ($F_B$) and harmonics ($H_1, H_2, \ldots, H_N$) components of the background noise (BN). In some embodiments, this ensures that the higher the background noise (BN), the higher the sampling rate (SR) in order to properly serve the two stage background noise (BN) control.

Figure 11:
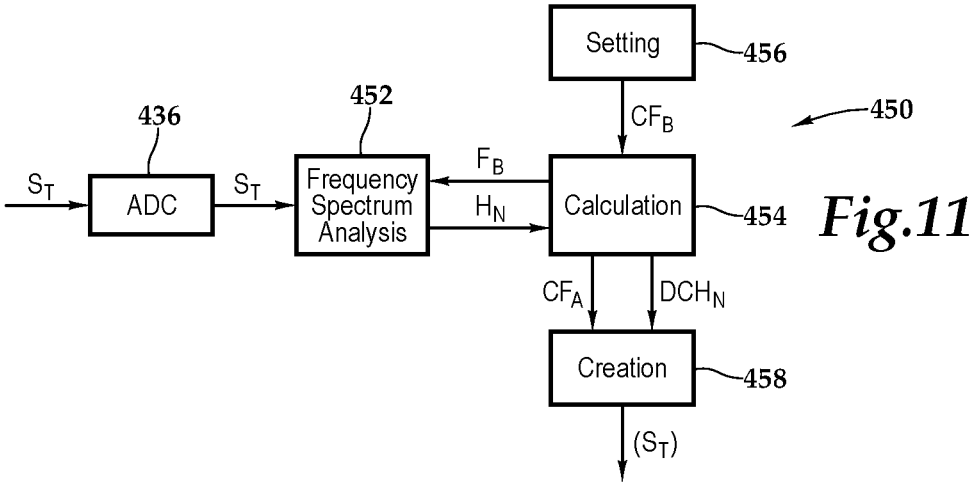
FIG. 11 is a functional block diagram depicting one embodiment of harmonics processing, according to the teachings presented herein.

Referring now to FIG. 11, in one embodiment of harmonics processing 450 which may be incorporated into the hearing aid 10, the ADC 436 receives total sound ($S_T$) as an input. The ADC 436 then performs the frequency spectrum analysis 452 which is under the control of the frequency spectrum analyzer 438, the sampling rate controller 442, and the sampling rate generator 444 presented in FIG. 10. The ADC 436 outputs a digital total sound ($S_T$) signal that undergoes the frequency spectrum analysis 452 which is subject to calculation 454. In this process, the base frequency ($F_B$) and harmonics ($H_1, H_2, \ldots, H_N$) components are separated. Using the algorithms presented hereinabove and having a converted based frequency ($CF_B$) set at block 456 as a target frequency range, the harmonics processing 450 calculates at block 454, a converted actual frequency ($CF_A$) and a differential converted harmonics ($DCH_N$) to create at block 458, a converted total sound ($CS_T$), which is the output of the harmonics processing 450.

More particularly, total sound ($S_T$) may be defined as follows:

$S_T=F_B+H_1+H_2+\ldots+H_N$, wherein $S_T$=total sound;

$F_B$=base frequency range, with $F_B$=range between $FB_L$ and $FB_H$ with $F_{BL}$ being the lowest frequency value in base frequency and $F_{BH}$ being the highest frequency Value in Base Frequency;

$H_N$=harmonics of $F_B$ with $H_N$ being a mathematical multiplication of $F_B$;

$F_A$=an actual frequency value being examined;

$H_{A1}=1^{st}$ harmonic of $F_A$;

$H_{A2}=2^{nd}$ harmonic of $F_A$; and $H_{AN}=N^{th}$ harmonic of $F_A$ with $H_{AN}$ being the mathematical multiplication of $F_A$.

In many hearing impediment cases, the total sound ($S_T$) may be at any frequency range; furthermore the two ears true hearing range may be entirely different. Therefore, the hearing aid 10 presented herein may transfer the base frequency range ($F_B$) along with several of the harmonics ($H_N$) into the actual hearing range (AHR) by converting the base frequency range ($F_B$) and several chosen harmonics ($H_N$) into the actual hearing range (AHR) as one coherent converted total sound ($CS_T$) by using the following algorithm defined by following equations:

$$\frac{F_A \times CF_{BL}}{F_{BL}} = CF_A \qquad \text{Equation (1)}$$

-continued $$\frac{CF_A}{F_A} = M \quad \text{Equation (2)}$$

$$CH_{AN} = M \times H_N \quad \text{Equation (3)}$$

wherein for Equation (1), Equation (2), and Equation (3):

M=multiplier between CFA and $F_A$;

$CS_T$=converted total sound;

$CF_B$=converted base frequency;

$CH_{A1}$=$1^{st}$ converted harmonic;

$CH_{A2}$=$2^{nd}$ converted harmonic;

$CH_{AN}$=$N^{th}$ converted harmonic;

$CF_{BL}$=lowest frequency value in $CF_B$;

$CF_{BH}$=Highest frequency value in $CF_B$; and $CF_A$=Converted actual frequency.

By way of example and not by way of limitation, an application of the algorithm utilizing Equation (1), Equation (2), and Equation (3) is presented. For this example, the following assumptions are utilized:

$F_{BL}$=170 Hz $F_{BH}$=330 Hz $CF_{BL}$=600 Hz $CF_{BH}$=880 Hz $F_A$=180 Hz

Therefore, for this example, the following will hold true:

$H_1$=360 Hz $H_4$=720 Hz $H_8$=1,440 Hz $H_{16}$=2,880 Hz $H_{32}$=5,760 Hz

Using the algorithm, the following values may be calculated:

$CF_A$=635 Hz $CH_{A1}$=1,267 Hz $CH_{A4}$=2,534 Hz $CH_{A8}$=5,068 Hz $CH_{A16}$=10,137 Hz $CH_{A32}$=20,275 Hz

To calculate the differentials (D) between the harmonics $H_N$ and the converted harmonics ($CH_{AN}$), the following equation is employed:

$$CH_{AN}-H_N=D \quad \text{equation.}$$

This will result in differential converted harmonics (DCH) as follows:

$DCH_1$=907 Hz $DCH_4$=1,814 Hz $DCH_8$=3,628 Hz $DCH_{16}$=7,257 Hz $DCH_{32}$=14,515 Hz

In some embodiments, a high-pass filter may cut all differential converted harmonics (DCH) above a predetermined frequency. The frequency of 5,000 Hz may be used as a benchmark. In this case the frequencies participating in converted total sound ($CS_T$) are as follows:

$CF_A$=635 Hz $DCH_1$=907 Hz $DCH_4$=1,814 Hz $DCH_8$=3,628 Hz

The harmonics processing 450 may provide the conversion for each participating frequency in total sound ($S_T$) and distributing all participating converted actual frequencies ($CF_A$) and differential converted harmonics ($DCH_N$) in the converted total sound ($CS_T$) in the same ratio as participated in the original total sound ($S_T$). In some implementations, should more than seventy-five percent (75%) of all the differential converted harmonics ($DCH_N$) be out of the high-pass filter range, the harmonics processing 450 may use an adequate multiplier (between 0.1-0.9) and add the created new differential converted harmonics ($DCH_N$) to converted total sound ($CS_T$).

Figure 12:
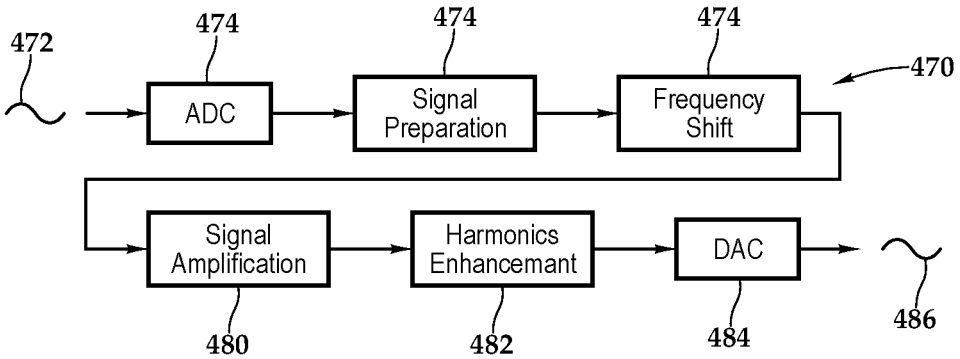
FIG. 12 is a functional block diagram depicting one embodiment of frequency shift, signal amplification, and harmonics enhancement, according to the teachings presented herein.

Referring now to FIG. 12, in one embodiment of signal processing 470 which may be incorporated into the hearing aid 10, an initial analog signal 472 is received. The initial analog signal 472 is converted by an ADC 474, before undergoing signal preparation by signal preparation circuit 474. Such signal preparation may include the operations presented in FIG. 10. The processed signal may be modified based on a subjective assessment of sound quality and before undergoing a frequency shift and signal amplification at circuit blocks 474, 480. Harmonics enhancement circuitry 482 processes the signal as presented in FIG. 11, for example, before the signal is converted from digital to analog at a DAC 484. The signal is then outputted as an analog signal 486.

Figure 13:
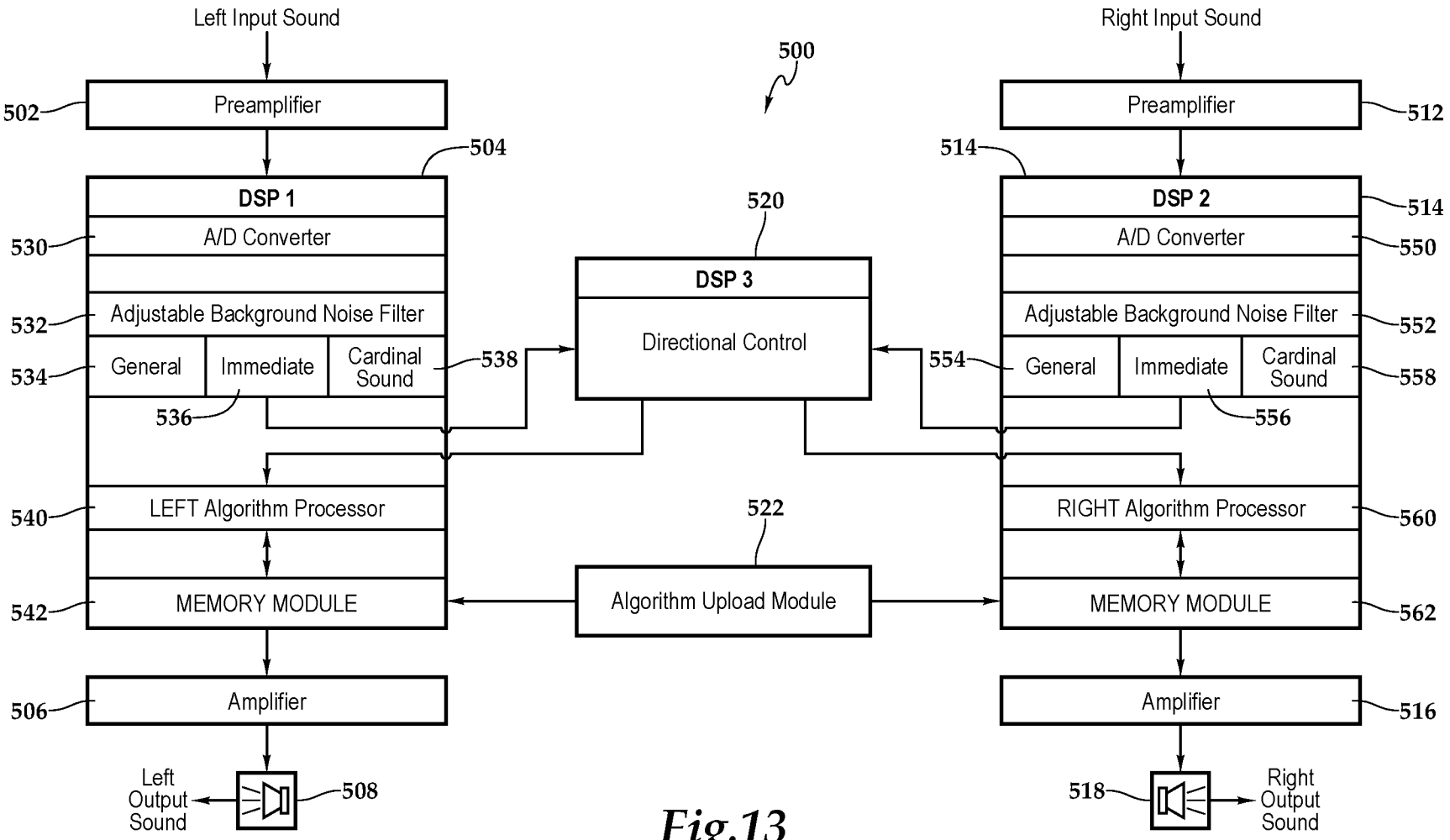
FIG. 13 is a functional block diagram depicting one embodiment of headset operational process flow, according to the teachings presented herein.

Referring now to FIG. 13, where one embodiment of an operational flow 500 for the hearing aid 10 is depicted. With respect to left sound input, left sound input is received at a preamplifier 502 for processing prior to the processed signal being driven to a digital signal processor 504, which performs an analog-to-digital conversion 530 prior to adjusting background noise according to a filter at block 532. Various filtering may occur, including general 534, immediate 536, and cardinal sound 538. The filtered signal is then driven to the digital signal processor 520 for directional control that compares left and right signals, and time delays between left and right signals. The result is a distributed left and right signal, which is based on the established left and right hearing capacity of the patient. The signal is then driven back to the digital signal processor 504 for left ear algorithm processing, which may include transforming the digital signal into a processed digital signal having the qualified sound range having the preferred hearing range with optional harmonics enhancement and optional modification with a subjective assessment of sound quality according to the patent to provide the best signal quality possible. A memory module 542 provides the instructions for the transformation, which may be uploaded by the algorithm upload module 522. An amplifier 506 receives the processed digital signal and delivers an amplified processed digital signal to a speaker 508 for left output sound.

Similarly, with respect to right sound input, right sound input is received at a preamplifier 512 for processing prior to the processed signal being driven to a digital signal processor 514, which performs an analog-to-digital conversion 550 prior to adjusting background noise according to a filter at block 552. Various filtering may occur, including general 554, immediate 556, and cardinal sound 558. The filtered signal is then driven to the digital signal processor 520 for directional control that compares left and right signals, and time delays between left and right signals. The result is a distributed left and right signal, which is based on the established left and right hearing capacity of the patient. The right portion of the signal is then driven back to the digital signal processor 514 for right ear algorithm processing, which may include transforming the digital signal into a processed digital signal having the qualified sound range including the preferred hearing range with optional harmonics enhancement and optional modification with a subjective assessment of sound quality according to the patent to provide the best signal quality possible. A memory module 562 provides the instructions for the transformation, which may be uploaded by the algorithm upload module 522. An amplifier 516 receives the processed digital signal and delivers an amplified processed digital signal to a speaker 518 for right output sound.

The order of execution or performance of the methods and data flows illustrated and described herein is not essential, unless otherwise specified. That is, elements of the methods and data flows may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A hearing aid for a patient, the hearing aid comprising:
a left and a right body connected by a band member;
each of the left and the right bodies at least partially conforming to contours of an external ear and sized to engage therewith;
each of the left and right bodies including an electronic signal processor, a microphone, and a speaker housed therein, a signaling architecture communicatively interconnecting the microphone to the electronic signal processor and the electronic signal processor to the speaker;
each of the electronic signal processors being programmed with a respective left ear qualified sound range and a right ear qualified sound range, each of the left ear qualified sound range and the right ear qualified sound range being a range of sound corresponding to a preferred hearing range of an ear of the patient modified with a subjective assessment of sound quality according to the patient; and
each of the electronic signal processors including a memory accessible to a processor, the memory including processor-executable instructions that, when executed, cause the processor to:
receive an input analog signal from the microphone,
convert the input analog signal to a digital signal,
transform the digital signal into a processed digital signal having the qualified sound range,
in a dominant sound mode of operation, identify a loudest sound in the processed digital signal and increase a volume of the loudest sound in the processed digital signal,
convert the processed digital signal to an output analog signal, and
drive the output analog signal to the speaker.

2. The hearing aid as recited in claim 1, wherein the memory further comprises processor-executable instructions that, when executed, cause the processor to, in an immediate background mode of operation, identify sound in an immediate surrounding to the hearing aid and suppress the sound in the processed digital signal.

3. The hearing aid as recited in claim 1, wherein the memory further comprises processor-executable instructions that, when executed, cause the processor to, in a background mode of operation, identify an extraneous ambient sound received at the hearing aid and suppress the extraneous ambient sound in the processed digital signal.

4. The hearing aid as recited in claim 1, wherein the memory further comprises processor-executable instructions that, when executed, cause the processor to:
in an immediate background mode of operation, identify sound in an immediate surrounding to the hearing aid and suppress the sound in the processed digital signal, and
in a background mode of operation, identify an extraneous ambient sound received at the hearing aid and suppress the extraneous ambient sound in the processed digital signal.

5. The hearing aid as recited in claim 1, wherein the microphone in the left body and the microphone in the right body cooperate to provide directional hearing.

6. The hearing aid as recited in claim 1, wherein each of the left body and the right body further comprise a plurality of microphones.

7. The hearing aid as recited in claim 1, wherein each of the left ear preferred hearing range and the right ear preferred hearing range being a range of sound corresponding to the highest hearing capacity of an ear of the patient between 50 Hz and 10,000 Hz.

8. The hearing aid as recited in claim 1, wherein each of the left ear preferred hearing range and the right ear preferred hearing range further comprises an about 300 Hz frequency to an about 500 Hz frequency range of sound.

9. The hearing aid as recited in claim 1, wherein each of the left ear preferred hearing range and the right ear preferred hearing range further comprise a range tested at 5 Hz increments.

10. The hearing aid as recited in claim 1, wherein the left ear preferred hearing range and the right ear preferred hearing range are mutually exclusive.

11. The hearing aid as recited in claim 1, wherein the left ear preferred hearing range and the right ear preferred hearing range at least partially overlap.

12. The hearing aid as recited in claim 1, wherein the left ear subjective assessment according to the patient further comprises a completed assessment of a degree of annoyance caused to the patient by an impairment of wanted sound.

13. The hearing aid as recited in claim 1, wherein the left ear subjective assessment according to the patient further comprises a completed assessment of a degree of pleasantness caused to the patient by an enablement of wanted sound.

14. The hearing aid as recited in claim 1, wherein the left ear subjective assessment according to the patient further comprises a completed assessment to determine best sound quality to the patient.

15. The hearing aid as recited in claim 1, wherein the left ear subjective assessment and the right ear subjective assessment are mutually exclusive.

16. The hearing aid as recited in claim 1, wherein the left ear subjective assessment and the right ear subjective assessment at least partially overlap.

17. The hearing aid as recited in claim 1, wherein the electronic signal processors are at least partially integrated.

18. The hearing aid as recited in claim 1, wherein the electronic signal processors are fully integrated into a single electronic signal processor.

19. A hearing aid for a patient, the hearing aid comprising:
a left and a right body connected by a band member;
each of the left and the right bodies at least partially conforming to contours of an external ear and sized to engage therewith;
each of the left and right bodies including an electronic signal processor, a microphone, and a speaker housed therein, a signaling architecture communicatively interconnecting the microphone to the electronic signal processor and the electronic signal processor to the speaker;

a transceiver communicatively interconnected to the signaling architecture communicatively, the transceiver being configured to provide a pairing with a proximate smart device;

each of the electronic signal processors being programmed with a respective left ear qualified sound range and a right ear qualified sound range, each of the left ear qualified sound range and the right ear qualified sound range being a range of sound corresponding to a preferred hearing range of an ear of the patient modified with a subjective assessment of sound quality according to the patient; and each of the electronic signal processors including a memory accessible to a processor, the memory including processor-executable instructions that, when executed, cause the processor to:

receive an input analog signal from the microphone, convert the input analog signal to a digital signal, transform the digital signal into a processed digital signal having the qualified sound range, in a dominant sound mode of operation, identify a loudest sound in the processed digital signal and increase a volume of the loudest sound in the processed digital signal, convert the processed digital signal to an output analog signal, drive the output analog signal to the speaker, create a pairing via the transceiver with the proximate smart device, and receive a control signal from the proximate smart device.

20. A hearing aid for a patient, the hearing aid comprising:

a left and a right body connected by a band member;

each of the left and the right bodies at least partially conforming to contours of an external ear and sized to engage therewith;

each of the left and right bodies including an electronic signal processor, a microphone, and a speaker housed therein, a signaling architecture communicatively interconnecting the microphone to the electronic signal processor and the electronic signal processor to the speaker;

a transceiver communicatively interconnected to the signaling architecture communicatively, the transceiver being configured to provide a pairing with a proximate smart device;

each of the electronic signal processors being programmed with a respective left ear qualified sound range and a right ear qualified sound range, each of the left ear qualified sound range and the right ear qualified sound range being a range of sound corresponding to a preferred hearing range of an ear of the patient modified with a subjective assessment of sound quality according to the patient; and each of the electronic signal processors including a memory accessible to a processor, the memory including processor-executable instructions that, when executed, cause the processor to:

receive an input analog signal from the microphone, convert the input analog signal to a digital signal, transform, via distributed processing between the hearing aid and the proximate smart device, the digital signal into a processed digital signal having the qualified hearing range, in a dominant sound mode of operation, identify a loudest sound in the processed digital signal and increase a volume of the loudest sound in the processed digital signal, convert the processed digital signal to an output analog signal, drive the output analog signal to the speaker.

* * * * *